US008808094B2

(12) United States Patent
DeSimone et al.

(10) Patent No.: US 8,808,094 B2
(45) Date of Patent: Aug. 19, 2014

(54) TOP BOX WHEEL ASSEMBLY AND GAMING MACHINE HAVING A TOP BOX WHEEL ASSEMBLY

(75) Inventors: Frank DeSimone, Henderson, NV (US); Michael Kolodziej, Austin, TX (US); Travis Bussey, Austin, TX (US); Brandon Fish, Austin, TX (US); Joel Shively, Austin, TX (US); Clint Owen, Austin, TX (US); JP Cody, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 0 days.

(21) Appl. No.: 13/225,287

(22) Filed: Sep. 2, 2011

(65) Prior Publication Data

US 2012/0122571 A1 May 17, 2012

Related U.S. Application Data

(60) Provisional application No. 61/413,460, filed on Nov. 14, 2010.

(51) Int. Cl.
*G07F 17/32* (2006.01)

(52) U.S. Cl.
USPC ..... 463/46; 463/30

(58) Field of Classification Search
USPC ..... 463/16–20, 30–32, 46–47
See application file for complete search history.

(56) References Cited

U.S. PATENT DOCUMENTS

| | | | | |
|---|---|---|---|---|
| 1,382,231 | A * | 6/1921 | Pyper | 40/436 |
| 4,440,457 | A * | 4/1984 | Fogelman et al. | 463/46 |
| 5,314,195 | A * | 5/1994 | Schulze | 273/371 |
| 2003/0064799 | A1 * | 4/2003 | Goins et al. | 463/30 |
| 2003/0064806 | A1 * | 4/2003 | Gordon et al. | 463/42 |
| 2004/0048645 | A1 * | 3/2004 | Webb et al. | 463/16 |
| 2005/0060051 | A1 * | 3/2005 | Mattice et al. | 700/92 |
| 2007/0287544 | A1 * | 12/2007 | Hirato et al. | 463/46 |
| 2008/0227530 | A1 * | 9/2008 | LeMay et al. | 463/22 |
| 2009/0117961 | A1 * | 5/2009 | Bennett et al. | 463/16 |
| 2009/0227314 | A1 * | 9/2009 | Bennett | 463/16 |

* cited by examiner

*Primary Examiner* — Arthur O Hall
*Assistant Examiner* — Jasson Yoo
(74) *Attorney, Agent, or Firm* — Russell D. Culbertson, Esq.; J P Cody, Esq.

(57) ABSTRACT

A top box wheel assembly and method are disclosed wherein a flat panel display is mounted on a rectangular shaped cabinet top box structure and a circular bezel structure overlays the flat panel display such that a wheel-shaped display area is provided. The circular bezel structure also is shown to include a rectangular cutout base to also provide a rectangular-shaped display area. The circular bezel structure is further shown to include a circular pattern of LEDs which may be operated synchronously or quasi-synchronously with the wheel-shaped display area on which a rotating wheel may be displayed together with an indicator.

13 Claims, 13 Drawing Sheets

TOP BOX WHEEL ASSEMBLY AND GAMING MACHINE HAVING A TOP BOX WHEEL ASSEMBLY

CROSS-REFERENCE TO RELATED APPLICATION

The Applicants claim the benefit, under 35 U.S.C. §119(e), of U.S. Provisional Patent Application No. 61/413,460 filed Nov. 14, 2010, and entitled "Top Box Wheel Assembly and Gaming Machine Having a Top Box Wheel Assembly." The entire content of this provisional application is incorporated herein by this reference.

COPYRIGHT NOTICE

A portion of the disclosure of this patent document contains material which is subject to copyright protection. The copyright owner has no objection to the facsimile reproduction of the patent document or the patent disclosure as it appears in the Patent and Trademark Office patent files or records, but otherwise reserves all rights of copyright whatsoever.

BACKGROUND OF THE INVENTION

1. Field of the Invention

This invention relates to top box gaming machine structures and associated methods. More particularly, the invention relates to top box wheel structures and methods wherein a rectangular shaped flat panel display is overlaid by a bezel structure to provide a wheel-shaped display area and programmable wheel and indicator images for display thereon.

2. Description of the Related Art

A variety of top box structures and wheel structures have been developed to provide wheel-based games.

There continues to be a need to provide alternative top boxes and wheel structures to improve gaming machine structures and to provide versatility in presenting different games to appeal to players and generate excitement in the gaming experience.

SUMMARY OF THE INVENTION

The present invention includes a top box wheel assembly and method wherein a flat panel display is mounted on a rectangular shaped cabinet top box structure and a circular bezel structure overlays the flat panel display, such that a wheel-shaped display area is provided and various wheel and indicator images may be programmed to be displayed thereon. The circular bezel structure also may include a rectangular cutout base, such that a rectangular-shaped display area is provided and various additional images may be programmed to be displayed thereon. The circular bezel structure may further include a circular pattern of LEDs which may be operated synchronously or quasi-synchronously with the wheel and indicator images. These and other features of the invention will be apparent from the following description of illustrative embodiments, considered along with the accompanying drawings.

DESCRIPTION OF ILLUSTRATIVE EMBODIMENTS

Figure 1:
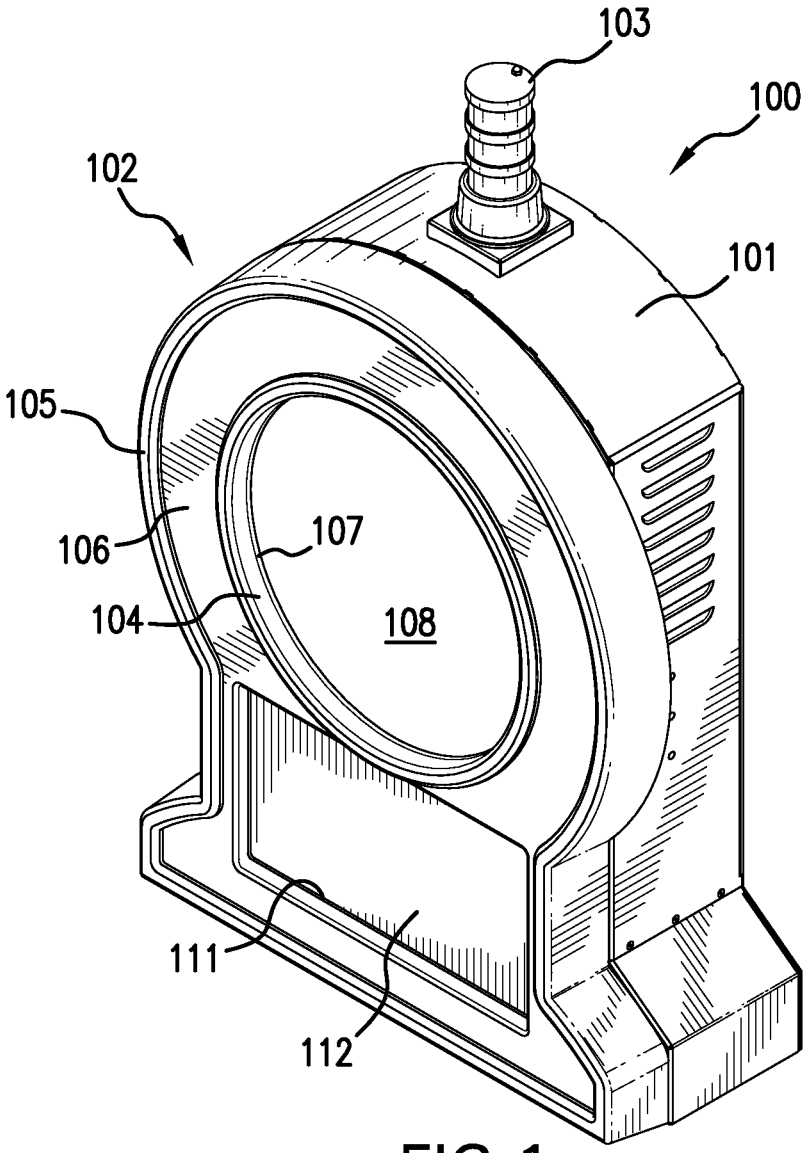
FIG. 1 is an isometric view showing an example gaming machine top box display according to one embodiment.

FIG. 1 shows an example top box 100 embodying principles of the present invention. Top box 100 includes a door assembly 102 and a housing assembly with a housing 101. In FIG. 1 the door assembly 102 is shown connected in an operating position to a front of the housing 101. This illustrated example top box 100 also includes a candle assembly 103 which is an assembly of lights which may be illuminated to signal certain events at the gaming machine using the top box. Door assembly 102 includes an inner door frame assembly 104, an outer door frame assembly 105 and a diffuser assembly 106. Diffuser assembly 106 provides much of the front surface of the door assembly. Door assembly 102 also includes a first opening 107 defined by inner door frame assembly 104 and through which a first display area 108 is visible from the front of top box 100. In addition to opening 107, the illustrated top box 100 also includes a second opening 111 which defines a second display area 112. As will be described below, at least a portion of the annular area between circular inner frame assembly 104 and the circular portion of outer door frame assembly 105 provides an accent light area which is backlit by a number of accent lights, which may be LEDs, and may be operated in a synchronized fashion with a wheel display within display area 108, or otherwise operated to provide desirable graphic effects at a gaming machine using top box 100.

Figure 2:
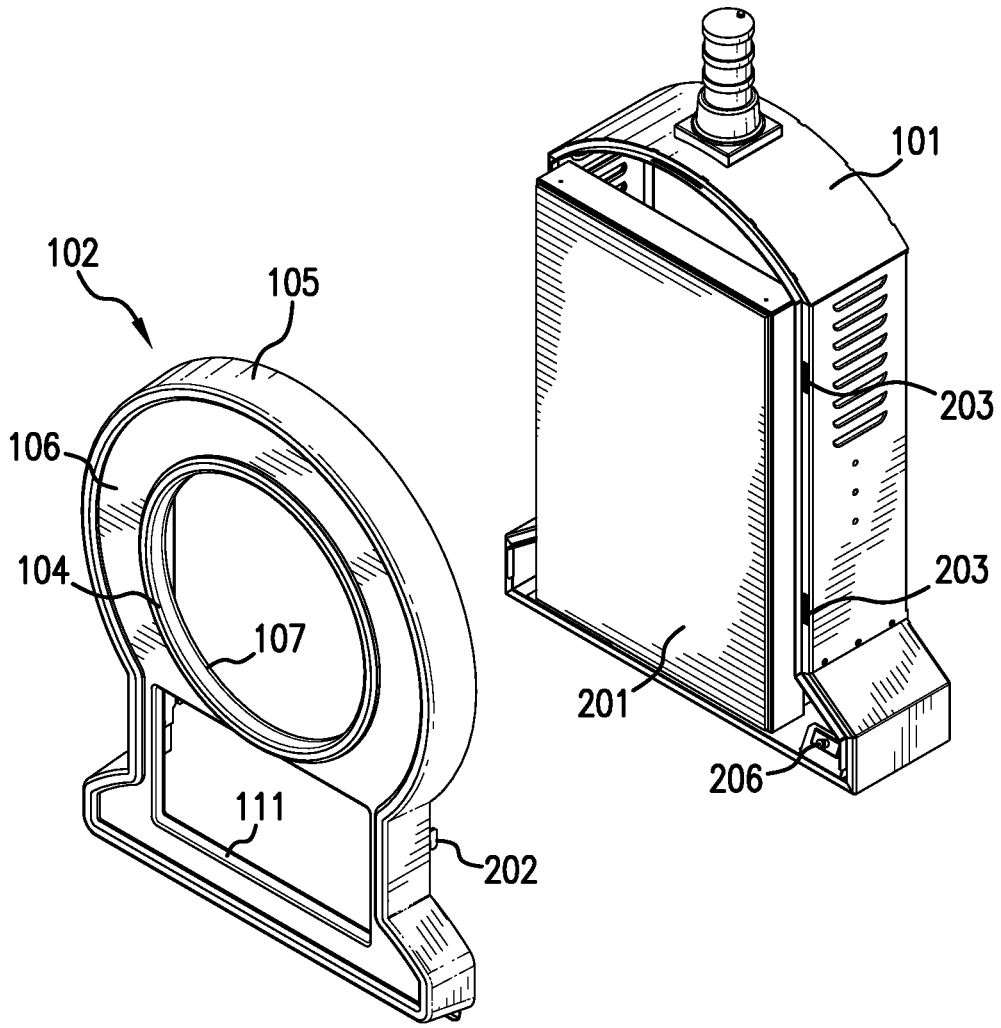
FIG. 2 is an isometric exploded view showing the gaming machine top box display of FIG. 1 separated into a door assembly and a housing assembly.

FIG. 2 shows top box 100 with the door assembly 102 removed from housing 101. This exploded view reveals a display device 201 mounted on top box housing 101. It will be apparent by comparing FIGS. 1 and 2 that when door assembly 102 is connected to housing 101, a portion of the display device 201 is visible through first opening 107. Thus display area 108 comprises an area of display device 201. Similarly, another portion of display device 201 is visible through second opening 111 so that second display area 112 comprises a different area of the display device 201. Thus the door assembly 102 effectively forms a bezel structure with a circular portion defined by inner door frame assembly 104 and a rectangular portion defined by opening 111. Referring again to the exploded view of FIG. 2, the illustrated example door assembly 102 includes fastening hooks 202 which each cooperate with a respective receiving slot 203 formed in housing 101. Although only one hook 202 and two slots 203 are visible from the view of FIG. 2, it will be appreciated that four such cooperating hook and slot arrangements are employed in the example to connect door assembly 102 to housing 101.

The view of FIG. 2 also shows a door position switch 206 mounted in housing 101 in position to contact a portion of door assembly 102 when the door assembly is connected to housing 101 in the position shown in FIG. 1. This door position switch 206 switches to the opposite position when the door assembly 102 is removed to provide a signal to the gaming machine that the door assembly has been removed.

Figure 3:
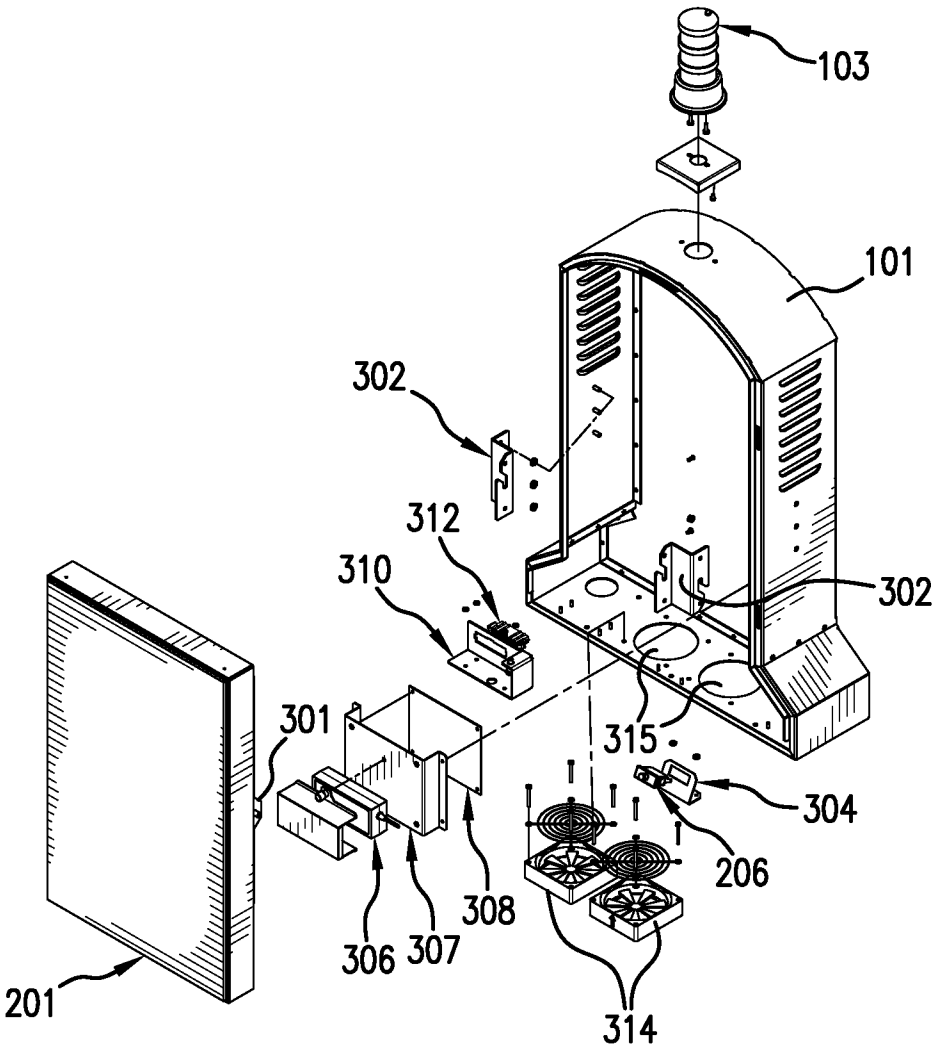
FIG. 3 is an isometric exploded view showing the housing assembly separated into various components.

FIG. 3 comprises an exploded view of just the housing 101 and the components mounted therein. In this particular example arrangement, display device 201 is mounted in housing 101 through a display connector 301 connected to the display device and display brackets 302 which are connected on opposite sides of housing 101. FIG. 3 also shows door position switch 206 along with the door position switch bracket 304 on which switch is mounted. In this illustrative embodiment of top box 100, housing 101 also houses an LED power supply 306 which is mounted on a controller bracket 307. An LED controller board 308 (also referred to herein as an accent light controller board) is also mounted on controller bracket 307. A connector bracket 310 is connected at the bottom of housing 101 and provides a location for mounting a connector 312 which provides an electrical communication connection from the gaming machine game processor described below to controller board 308. FIG. 3 also shows cooling fans 314 which are mounted over openings 315 at the bottom of housing 101.

Figure 4:
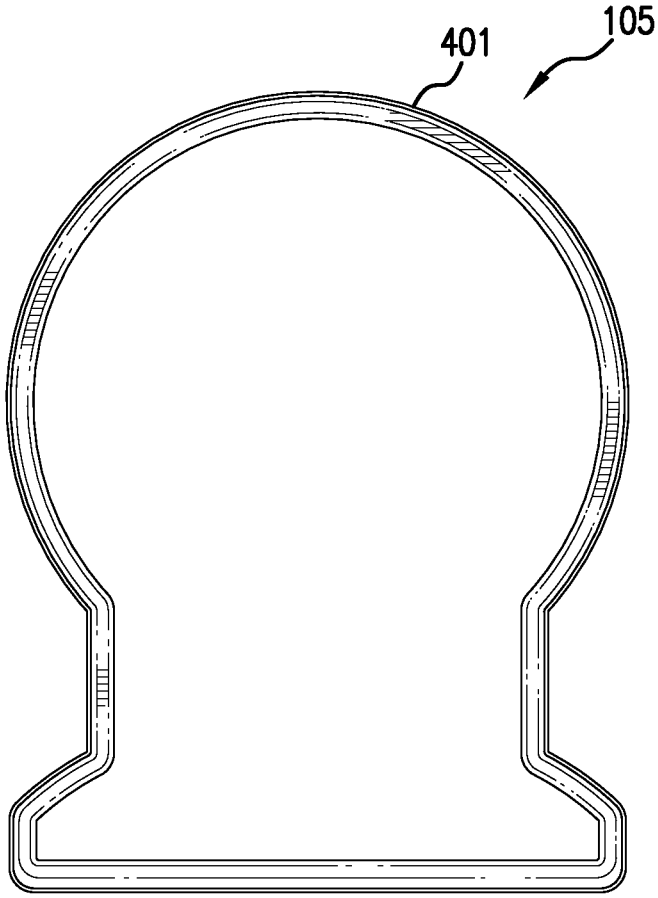
FIG. 4 is a front view of an outer door frame assembly of the door assembly shown in FIG. 2.
Figure 5:
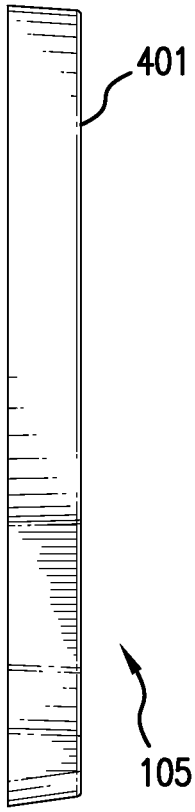
FIG. 5 is a left side view of the outer door frame assembly shown in FIG. 4.

As shown in FIGS. 1-3, door assembly 102 includes the outer door frame assembly 105. This outer door frame assembly 105 may include an outer decorative cover 401 shown in FIGS. 4 and 5 and an inner structural frame. This inner structural frame is concealed within the decorative cover 401 and is thus not visible in FIGS. 4 and 5. Decorative cover 401 may be made of any suitable material including a chromed plastic. The inner structural frame may be made of a suitable metal or rigid plastic and may provide a portion of the structure for mounting LED boards as will be discussed below in connection with FIG. 11.

Figure 7:
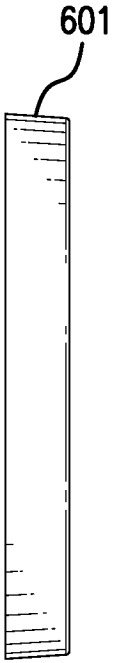
FIG. 7 is a left side view of the inner door frame assembly shown in FIG. 6.
Figure 6:
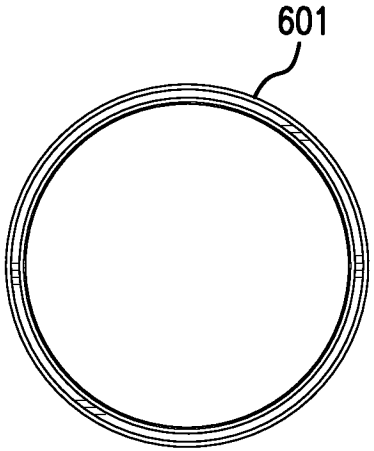
FIG. 6 is a front view of an inner door frame assembly of the door assembly shown in FIG. 2

In addition to outer door frame assembly 105, door assembly 102 also includes inner door frame assembly 104 which is shown by itself in FIGS. 6 and 7. Inner door frame assembly 104 includes a decorative frame cover 601 which is visible from the front of the door assembly, and a structural frame which is concealed within the inner decorative cover. Since the inner structural frame is concealed within inner decorative cover 601, the structural frame is not shown in the drawings. As with outer decorative cover 401, inner decorative cover 601 may be made of a suitable chromed plastic. The support structure concealed within inner decorative cover 601 may be a suitable metal or rigid plastic and may also provide a support for the LED boards described below.

Figure 8:
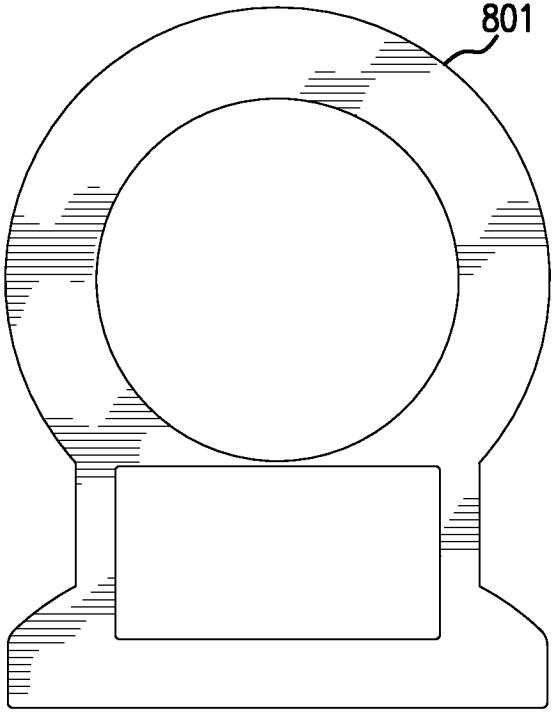
FIG. 8 is a front view of a diffuser cover of the door assembly shown in FIG. 2.

The illustrated example door assembly 102 shown in FIG. 1 may also include a diffuser cover 801 shown in FIG. 8. This diffuser cover 801 may comprise a thin translucent or transparent material such as an acrylic plastic which provides a cover and outer surface for the diffuser assembly 106 shown in FIG. 1. As mentioned in connection with FIG. 1 and as will be discussed further below, a number of accent lights, which may be LEDs for example, are visible in an accent light display area extending around at least a portion of display area 108 between inner door frame assembly 104 and outer door frame assembly 105. Diffuser cover 801 shown in FIG. 8 also provides the surface cover in the area around second display area 112.

Figure 10:
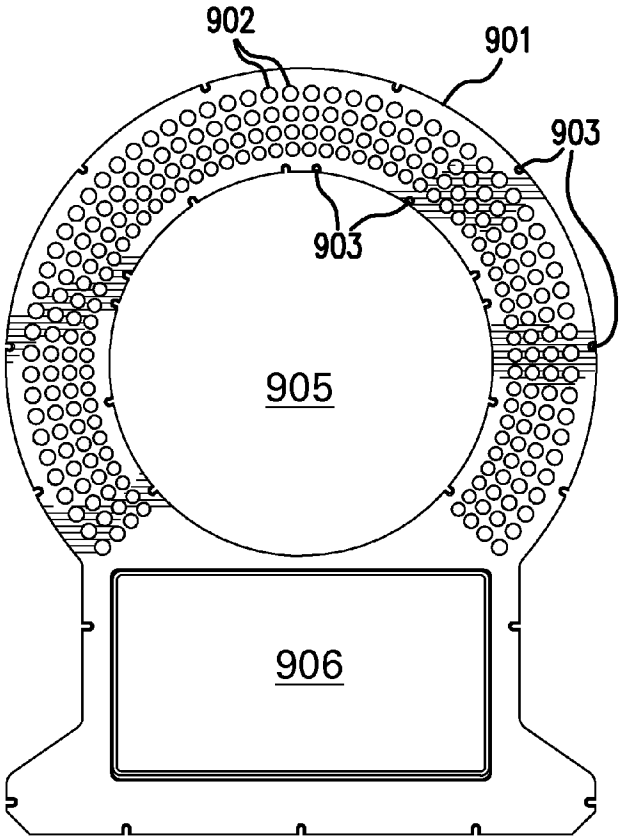
FIG. 10 is a rear view of the diffuser shown in FIG. 9.
Figure 9:
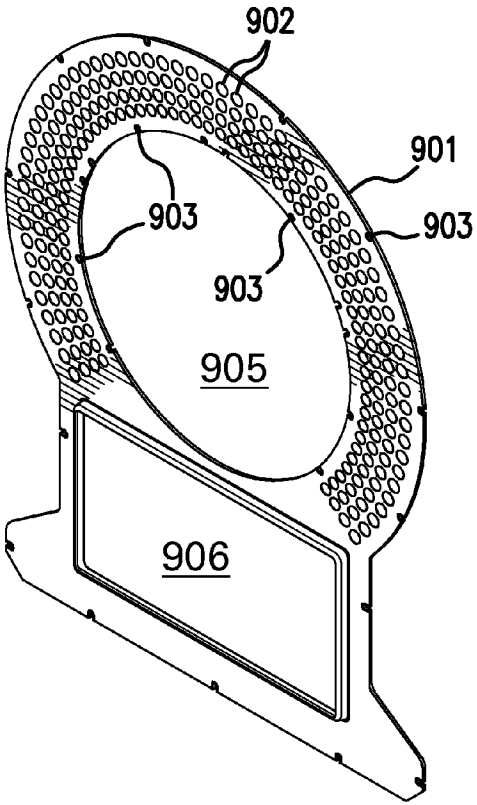
FIG. 9 is an isometric view of the rear side of the diffuser used in the example door assembly shown in FIG. 2.

The example door assembly 102 shown in FIG. 1 further includes a diffuser plate 901 shown in FIGS. 9 and 10. This example diffuser plate 901 includes a structure similar to diffuser cover 801, but may be made of a stronger plastic layer, such as a vinyl material for example. Diffuser plate 901 defines a respective light-transmissive opening 902 for each accent light (LED) included in the accent light display. These light transmissive openings 902 may be physical openings in the vinyl material or may be an area of the vinyl material having a light transmissive coating, that is, more light transmissive than a coating which may be on the remainder of diffuser plate 901. For example, the entire diffuser plate 901 may be silkscreened with a suitable color layer but may include openings in the silkscreened color or a different coating (or no coating) aligning with each light transmissive opening 902. In this example structure for door assembly 102 (FIG. 1), the diffuser plate 901 connects the inner door frame assembly 104 and the outer door frame assembly 105 (both of these assemblies also shown in FIG. 1). The illustrated example diffuser plate 901 includes a number of alignment notches 903 that help align the diffuser plate with the inner doorframe assembly and our doorframe assembly. These same sort of alignment notches may also be included in the diffuser cover layer 801 which fits over the diffuser plate 901 to form the complete diffuser assembly 106 shown in FIGS. 1 and 2. It will be noted by comparing FIGS. 9 and 10 with FIGS. 1 and 2 that in the fully assembled condition shown in FIGS. 1 and 2, inner door frame assembly 104 is connected to diffuser plate 901 with the opening 107 defined by the inner door frame assembly in registry with a wheel-shaped opening 905 formed in diffuser plate 901. Also, outer door frame assembly 105 is connected to diffuser plate 901 so as to define a periphery of door assembly 102 shown in FIGS. 1 and 2 with an annular area defined between a portion of the circumference of the inner door frame assembly 104 and a circular portion of the outer door frame assembly 105. Furthermore, in the assembled condition shown in FIGS. 1 and 2, the top box second opening 111 is in registry with a second opening 906 formed in diffuser plate 901.

Figure 11:
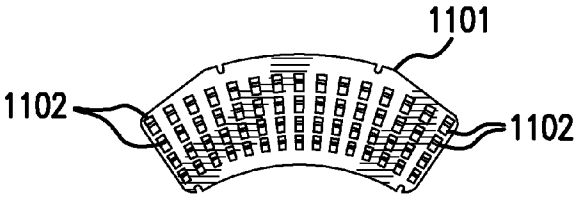
FIG. 11 is a front view of an LED board used in the example door assembly shown in FIG. 2.

FIG. 11 shows an accent light board 1101 which may be connected to door assembly 102 shown in FIG. 1. Several of these boards 1101 may be used to provide a respective light, such as an LED for example, behind each light transmissive opening 902 shown in FIGS. 9 and 10. Each individual accent light board 1101 includes a number of individual lights 1102. In this particular example, the accent lights 1102 are aligned in lines extending radially from a center axis of circular display area 108 shown in FIGS. 1 and 2. However, it will be appreciated that numerous different light arrangements may be used in a top box within the scope of the present invention. In one example implementation, each accent board 1101 is connected in the door assembly 102 on the structural frame within the inner door frame assembly 104 and the structural frame concealed within the outer door frame assembly 105 (elements 102, 104, and 105 being shown in FIG. 1). Regardless of how each accent light board 1101 is secured within door assembly 102, each accent light 1102 may be either a single color light or a light assembly of individual lights which may be controlled to produce different colors. Also, each accent light or accent light assembly aligning with a light transmissive opening 902 in diffuser plate 901 (FIGS. 9 and 10) may be separately controllable by a suitable controller such as that which will be described below in connection with FIG. 13. It will be appreciated that although the accent lights 1102 may be conveniently implemented as LEDs, the present invention is not limited to any particular type of light emitter for the accent lights.

Figure 12:
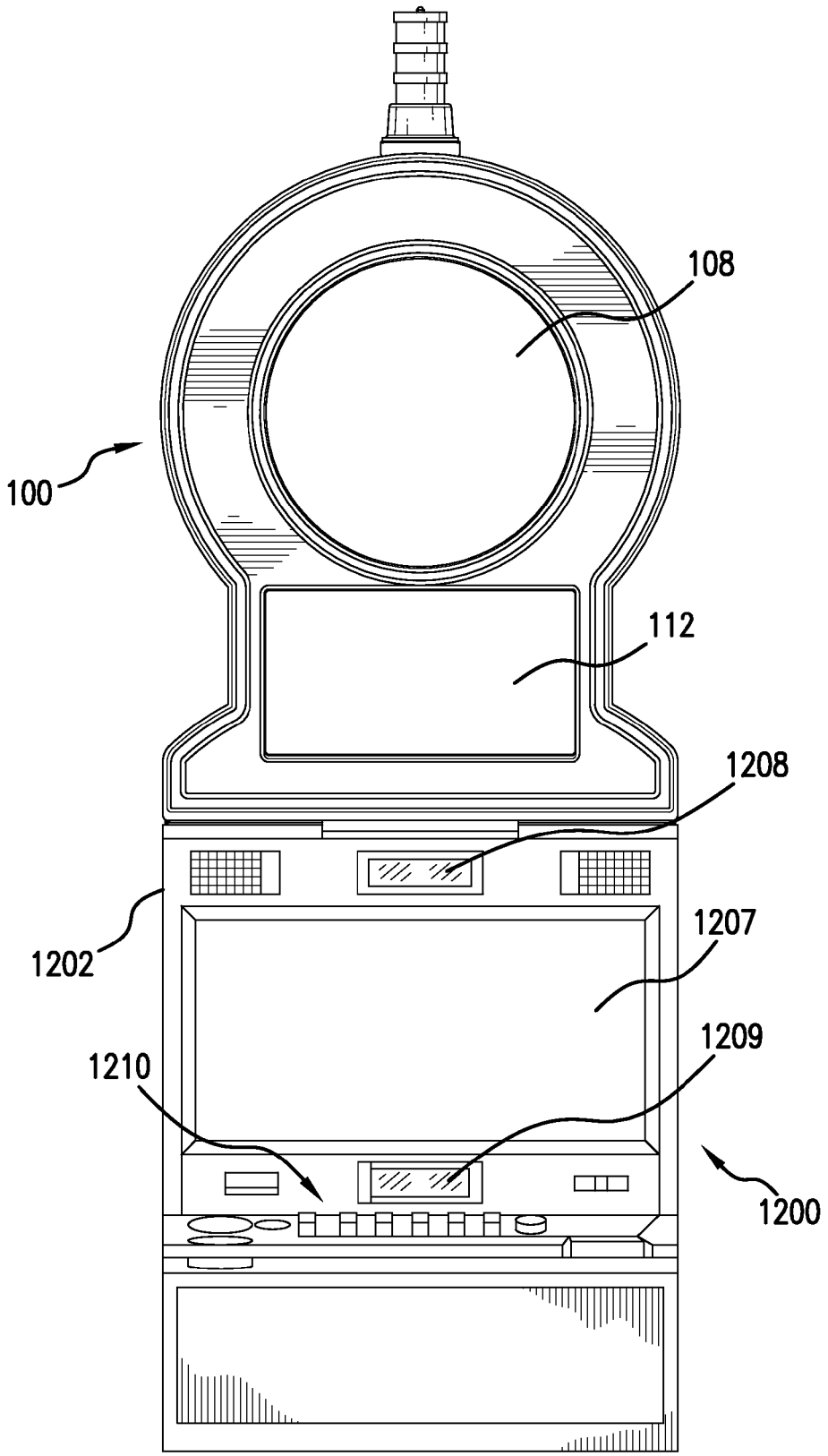
FIG. 12 is a front view of an example gaming machine using the example top box shown in FIG. 1.

FIG. 12 shows a gaming machine 1200 having a top box 100 as described above including circular display area 108 and rectangular display area 112, both defined by the door assembly/bezel on an underlying display, display 201 shown in FIGS. 2 and 3. These display areas, areas 108 and 112, may be used in games as described below. Gaming machine 1200 also includes a primary display 1207. Although primary display 1207 is shown as a video display, it may include a mechanical reel type display or any other type of display for showing gaming results to a player at the gaming machine 1200. Gaming machine 1200 also includes a middle display device 1208 and an auxiliary display device 1209, either or both of which may display a server-based game (such as bingo, in the case of a Class II gaming machine), advertising, or other content as may be provided over a network. Gaming machine 1200 further includes a player interface 1210 including preferably several different buttons or input devices (mechanical or touch screen implemented) with which a patron may place wagers and initiate play of one or more games at gaming machine 1200. All of the displays and other elements of gaming machine 1200 are housed in or about gaming machine cabinet 1202. While gaming machine 1200 is shown as an upright gaming machine cabinet style, various cabinet styles may be utilized including a slant-top cabinet style and a bar top cabinet style (where the cabinet may be part of a bar/table top and/or housed therein).

Where display device 1207 is used to display a reel-type game, each reel, whether simulated in video or an actual spinnable mechanical reel, will include a series of symbols viewable in the area of display device 1207. With the reels of the reel-type game in a stationary position, the symbols visible in area of display device 1207 may be viewed as an array of symbols. During a wagering game (as may be initiated by a player by placing a wager and pressing a 'PLAY' button included in player interface 1210), the reels may be simulated to spin (or electro-mechanically spun in the case of mechanical reels) about an axle under the control of a game processor which randomly or pseudo-randomly determines the game outcome and causes the reels to stop in accordance with the determined game outcome. Alternatively, the stop position of each reel (virtual position in the case of video reels and actual mechanical stop position in the case of mechanical reels) may be randomly or pseudo-randomly determined to determine the symbols included in the displayed array and therefore the result of the play. In still other arrangements, gaming machine 1200 may obtain an outcome for a given play from a remote server and cause the reels to stop to show a symbol combination consistent with the obtained outcome.

One or more paylines, combinations, or patterns of the symbols visible in the area of display device 1207, may be correlated to a game result payable in accordance with a paytable such as may be displayed in display area 112. For example, a game with five reels and displaying four symbol locations per reel may have four paylines which extend horizontally across each reel, and many other paylines which may zig and zag across the various reel symbol locations. A patron may wager on one or more of the paylines during each game play. The area of display device 1207 may thereby be used to display game results to a player at gaming machine 1200, and the game processor associated with the gaming machine may make payment to the player by incrementing a credit meter for winning outcomes (in accordance with the paytable) along paylines upon which the patron has wagered.

While example gaming machine 1200 may include a set of reels to show a game result, the invention is not limited to any particular type of game display in the area of display device 1207. Display device 1207 may comprise a video display showing a playing card game, dice game, roulette, bingo, or any other type of game or combinations of two or more types of games either concurrently, or sequentially.

In one or more alternative embodiments, primary display device 1207 may be controlled through program code executed by one or more processing devices associated with gaming machine 1200 to display a bonus or feature game that may be triggered by the appearance of one or more special symbols in an instance of a primary game or by the occurrence of some other random event. For example, when a bonus or feature game is triggered, the entire area of primary display device 1207 (or a portion thereof) may be transformed to display the bonus or feature game and once the bonus or feature game is complete, primary display device 1207 may revert to the primary game display state.

In one or more alternative embodiments, a touch-sensitive portion of display device 1207 may be programmed to display a player interactive element such as, for example, by displaying a selection of buttons and displaying a message to the player, 'choose a button,' implemented to enable player interactivity with the game, such as to select a displayed button or item, in order to cause the game to perform additional steps and/or provide one or more bonus or feature game outcomes and awards to the player.

In one or more alternative embodiments, gaming machine 1200 may include mechanical reels with fixed or dynamic symbols. Conventionally, mechanical reels include reel strips with fixed symbols; however, reel strips may be, for example, implemented using FOLED (flexible organic LED) or comparable reel strips wherein one or more symbols may be programmed dynamically to vary the symbol and/or its appearance, either from one fixed image to another (such as changing a symbol to a wild symbol or changing a series of symbols to wild symbols), or, from a fixed image to a dynamic (e.g. animated or video) image or a set of miniature video reels. In various instances when a symbol changes to another symbol, a bonus or enhanced award may be paid in accordance with the paytable or a multiple thereof, or may be paid separate from the paytable (for example, a fixed or progressive amount). In the event that the payment is a progressive award, a progressive pool may be generated from an operator's marketing dollars or from play at one or more gaming machines which may be eligible for the progressive award.

In one or more alternative embodiments, overlapping display panels may be implemented to generate video or display effects over reels; for example, portions of the area of display device 1207 may be implemented as a transmissive (e.g. Aruze or WMS transmissive display panels) display or a transparent (e.g. a Bally transparent display panels) display configured to display visual effects together with reels under the control of the game processor during the operation of a wagering game. In the case of virtual reels, the virtual reels may be recessed a distance from the surface of display device 1207 and segregated by dividers similar to dividers separating mechanical reels, which may provide a spatial characteristic (e.g. a PureDepth® display panel). In either case, the overlapping display may be touch-sensitive and configured to interact with the player by transmitting and receiving signals.

In one or more embodiments, the game processor operating the wagering game and interacting with various peripheral components in many instances is implemented as a microprocessor, such as an Intel Pentium® or Core® microprocessor, on a printed circuit board including one or more memory devices positioned within gaming machine 1200. In alternative implementations, the game processor may be remote from gaming machine 1200, such as on a server network connected to gaming machine 1200, in which case the game operation as described herein may be accomplished through network communications to control the display of the game on gaming machine 1200 including the lighting structure and effects as described above.

Figure 13:
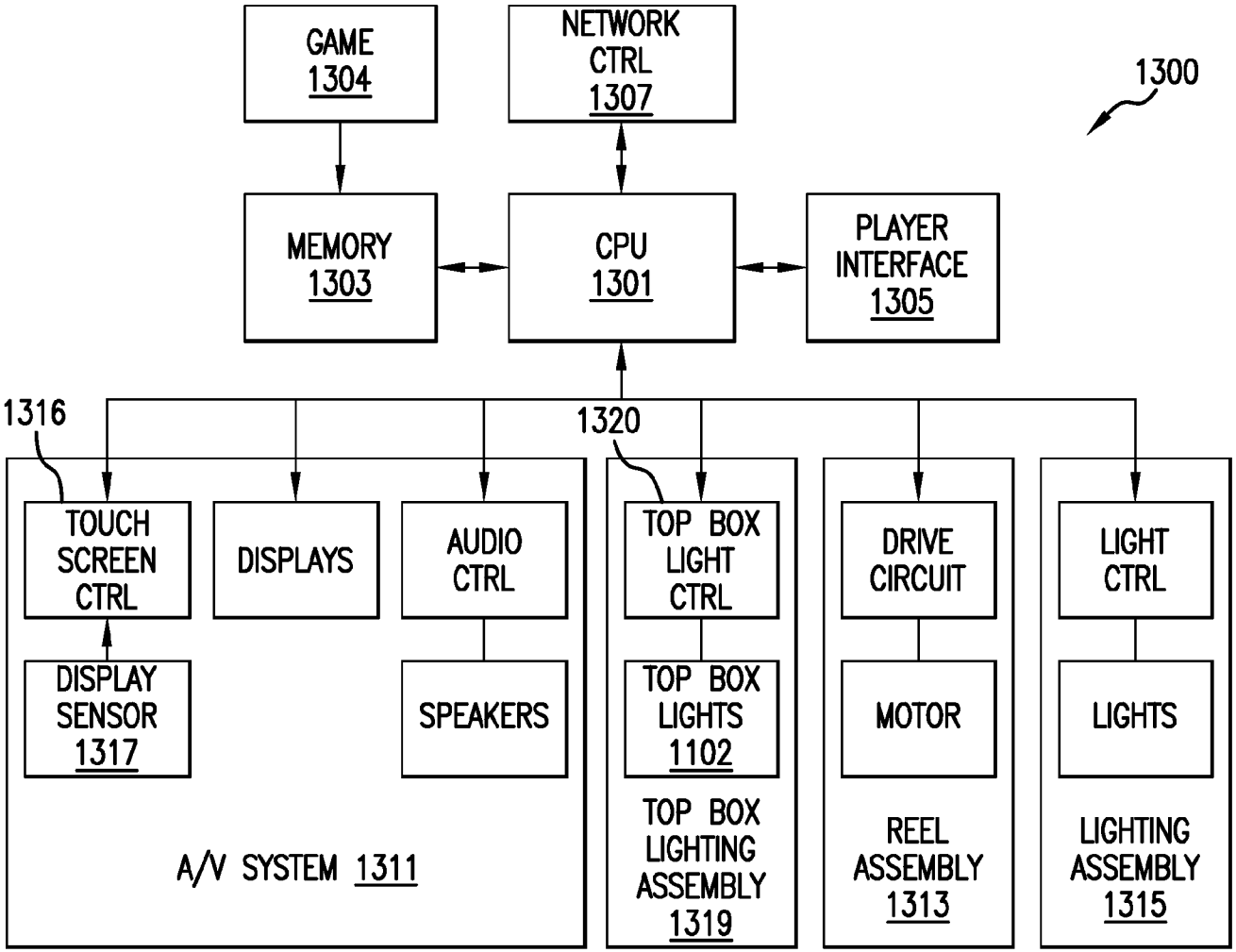
FIG. 13 is an example logic diagram of the components of the example gaming machine shown in FIG. 12.

FIG. 13 shows an example logical diagram 1300 of gaming machine 1200 including CPU 1301, memory 1303 with wagering game 1304, player interface 1305, network controller 1307, audio/visual (A/V) system 1311, reel assembly 1313 (if mechanical reel configuration), and lighting assembly 1315. It will be noted that the abbreviation "CTRL" is used for "controller" in the legends included in FIG. 13. The game processor, that is, CPU 1301, may comprise a conventional microprocessor, such as an Intel Pentium® or Core® microprocessor, mounted on a printed circuit board with supporting electronics, ports, drivers, memory, and program code to communicate with and control gaming machine operations, such as through the execution of program code stored in memory 1303 including one or more wagering games 1304. Game processor 1301 connects to player interface 1305 such that a player may make inputs and game processor 1301 may respond according to its programming, such as to apply a wager and initiate execution of a game.

Game processor 1301 also may connect through network controller 1307 to a gaming network, such as example casino server network 1800 which may be implemented over one or more site locations and include host server 1801. This arrangement will be described below in connection with FIG. 18.

Game processor 1301 may also connect to various devices within and about the gaming machine including A/V system 1311, reel assembly 1313 (for mechanical reel assemblies), and reel lighting assembly 1315 through respective controllers.

Generally, activity at gaming machine 1200 is initiated by a player inserting currency (which may include government-issued currency and/or privately issued vouchers) and/or a player card into a bill acceptor and card reader, respectively. Upon insertion, a signal is sent to game processor 1301. In the case of the insertion of a player card, the card reader transmits card information which is directed through network controller 1307 to a player tracking server connected to the network. Player data is transmitted to gaming machine 1200, and responsive to the data, game processor 1301 may execute coding causing player data and a display (and possibly an audio) command to be transmitted to one of the video and/or audio controllers instructing the controllers to display player information on a respective display and possibly issue an audio greeting through one or more respective speakers. Concurrently, the bill acceptor sends a signal to game processor 1301 which may include an identification of the currency that has been read, and game processor 1301 in accordance with its coding may convert the currency amount to credits and transmit a store and display signal to a credit meter and its associated display. Once credits have been associated with the credit meter, the player may select the number of paylines and credits per line that the player wishes to wager, whereupon game processor 1301, in accordance with its coding, receives the wager information from user interface 1305, transmits accounting and display information to the payline ("Lines"), credits per payline ("Bet per Line), and total bet ("Total Bet") meters and displays, transmits an update to the credit meter and display ("Credits") deducting the amount of the total bet, and initiates the wagering game.

In the case of Class III gaming devices, when a game is initiated, a random number generator (RNG) may be operated by game processor 1301 to determine the game outcome. Commonly, game processor 1301 is positioned within gaming machine 1200 and configured to manage the operation of the gaming machine components, such as shown in FIG. 12. However, the game processor may be either onboard or external to a gaming device played by a player, such as an electronic tablet (e.g. Apple iPad® or gaming specific tablet), personal data assistant (PDA), cellular telephone (e.g. Blackberry® or Apple iPhone®), surface table (e.g. Microsoft/IGT touch-sensitive gaming surface table), etc. In such case, when the player places a wager and initiates play of the game through user interface 1305 of the gaming device, the game processor may be onboard or remotely located such as within a network gaming server. In the latter case, an onboard microprocessor, controller, or digital signal processor may execute coding to transmit the wager and game request information through the network, and the remote game processor may operate an RNG to determine the game outcome.

In the case of Class II gaming devices, the overall structure of the various devices as discussed above is essentially the same with the major difference being the method of determining the game outcome. Commonly, Class II gaming devices utilize the game of bingo as the basis for determining a winning outcome where the ball draw is performed remotely by a network or central determination server (alternative games may be used for determining game outcomes, such as through a lottery drawing of a finite set of numbers, if permitted by the licensing jurisdiction). Class II gaming systems are commonly referred to as central determination systems wherein pools and sub-pools of game outcomes are determined by a central server (or gaming device) and distributed amongst a set of networked gaming devices. The distribution step may be on demand, such as when a gaming device receives a game request, or sets of game outcomes may be distributed to the various networked gaming devices in which case the game processor of the requesting gaming device may select a game outcome from the set of game outcomes, such as by using an RNG or other selection process.

Additionally, Class II gaming devices, such as a bingo-based gaming device may have multiple displays, such as are shown in FIG. 12 wherein one of the displays may be used to display one or more electronic bingo cards and one or more ball drawings after a game has been initiated in accordance with the game outcome that has been provided to the gaming device by a central determination server. In the case, where the primary display comprises a set of reels, game processor 1301 may convert the centrally-determined game outcome to a corresponding value outcome of the reel-based game, and may control the reels to display an appropriate result for the play.

In one or more embodiments, coding may be implemented and stored in memory 1303 and/or 1304, executable by game processor 1301 to control game operation, display content, lighting, and audio through video, audio, reel drive motor controllers (for mechanical reels), and lighting controllers.

It will be noted that the illustrated A/V system 1311 includes a touch screen controller 1316 associated with a display sensor 1317. In particular, one or more of the devices display associated with the gaming machine (such as a video display or a transmissive (or transparent) display over a set of mechanical reels, for example) may comprise a touch-sensitive display. The touch screen controller 1316 receives signals from a sensor arrangement 1317 associated with a given display screen or area, and uses those signals to generate coordinate data which is then communicated to CPU 1301 which causes the executing program code to act on the touch screen touch coordinate data. The sensor arrangement 1317 may employ any touch screen sensor technology such as, for example, a resistive film, capacitive arrangement, acoustic arrangement, optical sensor arrangement, or any other touch screen sensor technology. In one example implementation, touch screen controller 1316 communicates with CPU 1301 through a suitable serial interface such as a USB connection. However, it will be appreciated that a touch-sensitive display as described herein is not limited to any particular technology or arrangement for communication between the touch screen controller and the game processor or other processing device.

FIG. 13 also shows a logical representation for a top box lighting assembly 1319 such as top box 100 shown in FIG. 12. The top box may include the accent light arrangement which may be provided by the accent lights 1102 (shown in FIG. 11) These accent lights 1102 may be provided in the annular area around circular display area 108 (FIGS. 1, 2, and 12). The top box lighting assembly 1319 includes a top box light controller 1320 (which may also be referred to as an accent light controller). This controller may be implemented on or through the controller board 308 in FIG. 3. In particular, top box light controller 1320 may receive inputs from CPU 1301 and controls the operation of the various lights 1102 included in the accent light/top box light arrangement. Controller 1320 may have the ability to control the color of each light 1102 and the light intensity. Alternatively, controller 1320 may control groups of individual lights such as a single radial line of individual lights 1102. The communications between controller 1320 and CPU 301 may be made in any suitable fashion, such as, for example, over a serial data connection (RS-232, USB, Firewire, or any other communication standard or protocol). As will be described in connection with FIG. 14, controller 1320 may also communicate accent light/top box light state signals back to CPU 1301 to allow CPU 1301 to coordinate the display shown on the displays included in gaming machine 1200, and in particular, in the display area 108 of the top box.

Figure 14:
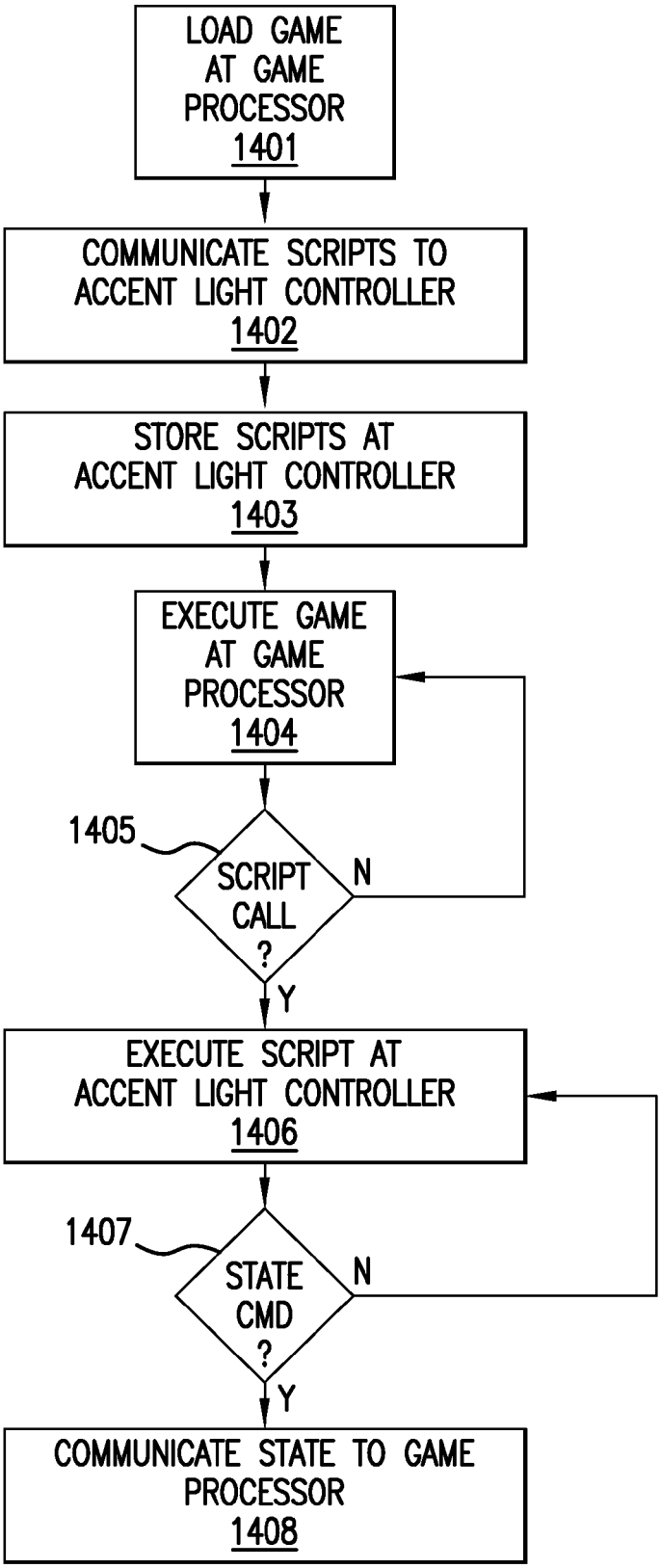
FIG. 14 is a flow chart showing an example of how the LED lights may be controlled in the top box shown in FIG. 12.

FIG. 14 shows and example of a process flow associated with controller 1320. As shown at 1401, the game processor 1301 may load a game such as at the startup of the machine or during a game change at the machine where the gaming machine is configurable to offer different games. As part of loading the game, CPU 1301 communicates scripts to controller 1320 as shown at step 1402. These scripts are stored in suitable memory associated with controller 1320 as indicated at 1403. Thereafter, as the game is executed by CPU 1301 as indicated at block 1404, the game may call for a script to be executed by the controller 1320. If the script is to be executed as indicated at decision block 1405, controller 1320 executes the script as indicated at block 1406. This may include lighting the various accent/top box lights 1102 in some pattern or to provide some effect. It will be noted that in this arrangement, controller 1320 controls lights 1102 independently of CPU 1301 once the script starts. At some point in the execution of the script, the script may call for a state signal or some other signal to be sent back to CPU 1301. If so, controller 1320 communicates the required signal to CPU 1301. This arrangement is convenient for enabling controller 1320 to let the CPU 1301 know when certain lighting states have been completed or are in progress. CPU 1301 may use this information to coordinate the images generated on display device 201 in circular display area 108 or in display area 112 (108 and 112 shown particularly in FIGS. 1, 2, and 12).

Figure 15:
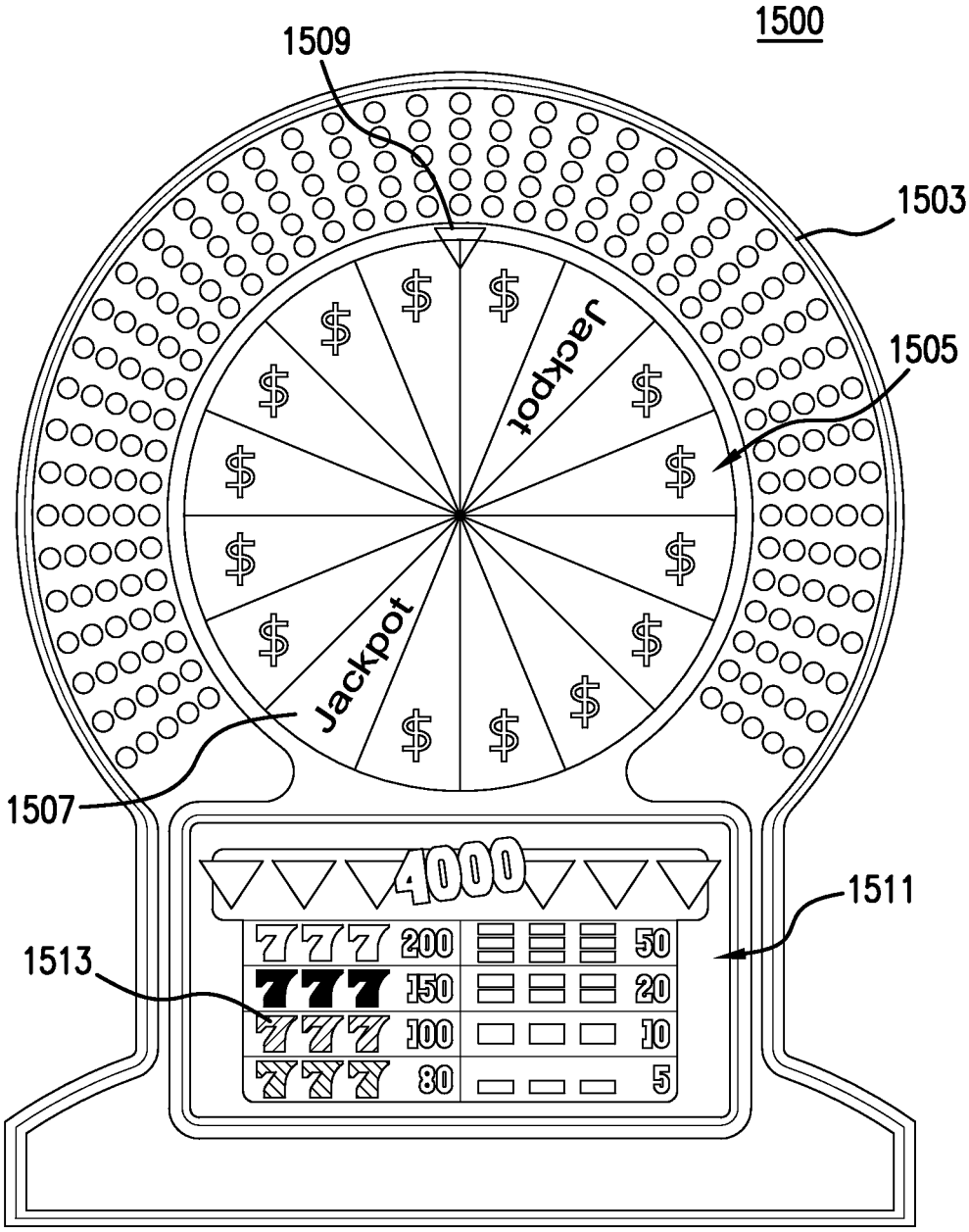
FIG. 15 is front elevation view of the example top box assembly shown in FIG. 1, but including game graphics shown on the exposed display areas.

Referring to FIG. 15, top box wheel assembly 1500 (which corresponds to assembly 100 in FIG. 1) is shown in accordance with the invention wherein one or more flat panel displays may be mounted on a rectangular shaped cabinet top box structure and circular bezel structure 1503 overlays the flat panel display, such that wheel-shaped display area 1505 (corresponding to display area 108 in FIG. 1) is provided and various wheel segment and indicator images, 1507 and 1509, respectively, may be programmed to be displayed thereon.

The example wheel image shown in wheel-shaped display area 1505 may be displayed with wedge segment partitions 1507 which may have different values associated with various of the wedge segments. For example, two segments 1507 are shown with 'Jackpot' indicating that if the wheel image is rotated and stops with indicator 1509 pointing to one of the Jackpot segments, a player may be awarded a jackpot award. The other segments 1507 are shown with the symbol '$' as a placeholder wherein various award values may be displayed during the presentation of a game.

Indicator 1509 may be programmed to display in an overlaying manner with respect to wheel segment images 1507. Wheel segment images 1507 may be controlled to produce an apparent rotating motion while indicator 1509 may be displayed in a fixed location. In an alternative embodiment, indicator 1509 may be a physical element or portion of circular bezel structure 1503.

In another embodiment, wheel image segments 1507 may be fixed in position while indicator 1509 may be shown as apparently rotating about the circumference of wheel image made up of segments 1507.

In another example embodiment, indicator 1509 may be a light indicator which may illuminate one segment 1507 of the wheel image at a time. In such case, the wheel image may provide the apparent rotating motion and indicator 1509 may remain in one position. In one or more examples, indicator 1509 may be implemented as a single light source, such as a single bright white LED, or several closely grouped lights, such as located at or about the location of indicator 1509 as shown in FIG. 15.

In another embodiment, indicator 1509 may be implemented through programming to add additional illumination to the pixels of a selected area of the display which may correspond to a segment area 1507. In this case, the wheel image may be programmed to stop so that a single wedge segment 1507 corresponds to the illuminated portion. Alternatively, the programming of the wheel may include specific display instructions for each wedge segment 1507, so that each wedge segment may sequentially be programmed to illuminate at a higher light intensity than their normal state. The cycle associated with the sequential illumination of each wedge segment 1507 may be programmed to be a constant speed until stopped or the cycle may have a variable speed, such as fast to slow to provide the appearance of a wheel and/or the illumination slowing down to a stop. In one example, the wheel image may remain fixed in place with the illumination effect rotating from wedge segment 1507 to wedge segment 1507 according to the programmed cycle. In another example, the wheel image may rotate as the segment illumination effect cycles. For instance, wheel image segment 1507 may have apparent rotation in the clock-wise direction while the indicator 1509 may have apparent rotation in the counter-clockwise direction. If both have the same rotational speed, then the illuminated segment may appear to be stationary such as at the top of the wheel. In another embodiment, the illumination effect may be non-sequential and random or quasi-random or the cycle of illuminating wedge segments 1507 may be constant until stopped or may be gradually slowed.

In one or more embodiments, a first display may overlay a second display. In such an example, the wheel image made up of segments 1507 may be displayed on the second display while indicator 1509 may be displayed on the first display. Additional special effects such as fireworks and other celebratory images may be programmed onto the first display once wheel and indicator images come to apparent rest. Such special effects may also be programmed with a single display. A spatial effect may be obtained through programming or by implementation of a display device to produce the effect. Audio effects may also be programmed to transmit sound effects through available speakers both during the game presentation and during a celebratory presentation. For example, a 'click, click, click' sound of a mechanical wheel may be emulated (or substantially copied), stored and one or more sound tracks played from the beginning fast speed through the slow down to a stop, and, various other sounds may be stored and played to enhance the A/V effect of the wheel game presentation.

In another example, in one embodiment wheel image having segments may be programmed with the appearance of a roulette wheel and an indicator may be programmed with the appearance of a ball. Both wheel segment and indicator images may be provided apparent rotation in opposite directions and be programmed to apparently slow down until the ball comes to rest on one segment. Additionally, sound effects may be incorporated such as the sound of a spinning wheel and ball bouncing.

In another example, a wheel image may be programmed with a tunnel including a number of ring segments and the segments may have graduated circumference from the center to the outer radius of the wheel image. In such case, each ring segment may be sequentially illuminated or programmed to display as an illuminated segment, and the sequence may be initiated from the center (e.g. the bulls eye of a dart board) to the outer ring segment (outer circumference) and/or from the outer segment to the center ring segment. The ring segments may respectively be associated with different award values similar to a dartboard. Ring segments may have smaller and greater widths, such as from the center to the outer segments, and the illumination cycle may vary faster to slower as the illumination effect progresses from the inner to outer ring segment.

In another example, a wheel image may be programmed to display as a dartboard. An illumination indicator may cycle from the bulls-eye to the outer segments in a pattern, randomly, or pseudo-randomly. For example, an illumination effect may illuminate portions of each wedge in a sequence, such as from the bulls-eye (which may be the jackpot award) to the next segment (example award 50) to a doubler segment (example award 50×2) to a next outer segment (example award 25) to a doubler segment (example award 25×2) and to an outer segment (example award 10). Alternatively, the illumination effect may randomly or pseudo-randomly illuminate one wedge portion at a time anywhere on the displayed dartboard. In one example, the game presentation ends when the illumination stops moving from location to location. At this point, some celebratory display may occur, such as a display of the amount won across a portion of the display area. In another example, the game presentation may include more than one award selection, so that after a first award, the illumination effect may re-commence until another selection is made, and so forth. The same may be the case in the various other wheel game examples.

Circular bezel structure 1503 also may include a rectangular cutout base, such that rectangular-shaped display area 1511 (corresponding to display area 112 in FIG. 1) is provided and various additional images may be programmed to be displayed thereon. For example, paytable 1513 may be displayed on rectangular-shaped display area 1511 where the awards associated with paytable 1513 may correspond to a base game. Display area 1511 may also display one or more progressive awards, for example, the Jackpot award may be a progressive award. When a game presentation is provided on the wheel graphic in area 1503 in FIG. 15, display area 1511 may display the award and/or various special effects (and speakers may provide audio effects) in accordance with programming executed by a processor (such as a game microprocessor or display controller). A display controller may be configured to control display content on the flat panel display (e.g. alternate example wheel figures) and the bezel lighting, or there may be separate controllers that may be operable under the control of another processor, such as a game processor which may be locally (e.g. gaming machine) or remotely (e.g. network server) connected to top box wheel structure 1500.

Circular bezel structure 1503 may further include a circular pattern of single- or multi-color LEDs (corresponding to accent or top box lights 1102 described in connection with FIG. 11) which may be operated synchronously or quasi-synchronously with the wheel and indicator images. For example, in the case of a rotating wheel or indicator image, the bezel lighting may rotate lighting or coloring about the circumference of wheel display area 1505. In the case of a tunnel wheel, the bezel lighting may light or change color from the outer circumference to the inner circumference and/or vis-a-versa. In the case of a random indicator, the bezel lighting may illuminate portions of the bezel corresponding to the location of the illumination effect.

In another embodiment, circular bezel structure 1503 may include a FOLED display instead of the LEDs. FOLED display film may be shaped in a circular pattern and programmed through a controller to display a similar pattern of lighting as the LEDs. Additionally, the FOLED display film may be programmed to display additional images such as an undulating flashing lighting when a big win occurs during a wheel game presentation. Also, various video features may be programmed, such as cartoon characters displayed running around the circumference of wheel display area 1505, or celebratory performances.

In another embodiment, the wheel display area 1505 may in fact be the position of a mechanical wheel which may have a programmable surface, such as may be implemented using a flat panel or FOLED display which may be supported with a rigid structure (if needed) and rotatable about an axle located at the center of the wheel. Display content may be transmitted from the game processor such as when the wheel is stationary. Display content may also be driven such as through electrical, inductive, or wireless communication with transmitting and receiving circuitry located proximally, such as near or about the axle location.

While a wheel game using top box wheel assembly 1500 may be initiated by a processor or by a processor in combination with a player touching a 'PLAY' button or touching (or sliding a finger or hand along) a touch sensitive primary game display, top box wheel assembly 1500 may include a touch panel display enabling an interaction of the player with the wheel, such as by the player touching (or sliding a finger or hand along) a portion of wheel display area 1505 to initiate spinning of the wheel.

In one or more embodiments, in addition to different values, the Wheel or Tunnel provided through top box structure 1500 could have enhancement features that may transfer to the primary game (e.g. modify symbols on reels). An enhancement feature example may occur when the wheel stops at a segment with an enhancement provision such as to modify one or more symbols of a reel or reels of a primary game, such as modifying one or more original symbols to wild symbols in the primary game and providing a number of Free Spins with the modified wild symbols. Another example may be to provide one or more wheel segments with a number of Free Spins in the primary game.

In one or more embodiments, the colors of the wheel segments or tunnel rings may enhance payouts on the winning combination of the primary game. For example, when landing on a blue tunnel ring or blue wheel segment, if this matched the color of a winning combination of say blue 7s (or other color combination) on the primary game, then the primary game may pay for example "double", "triple", etc. in addition to an amount or multiple displayed on the indicated segment of the tunnel or wheel.

In a video application, the top tunnel or wheel enhancement provided through top box 1500 could be utilized to trigger display of a second game in another display window, such as the primary display device 1207 in FIG. 12, which may then play and pay an award depending upon the outcome. Once completed, the display may revert to displaying the primary game.

In one or more embodiments, the wheel display area 1505 shown in FIG. 15 may display a 'magic' or 'mystical crystal' ball (e.g. magic 8 ball, or, other structure or artifice, such as one or more displayed windows which may open) that may reveal various awards, prizes, features (such as doubling the primary game award, providing a number of free spins in the primary game, or providing additional awards from the 'magic' or 'crystal' ball), or combinations thereof.

In any of the above implementations and variations, the game, such as a wheel game, displayed in wheel display area 1505, may be triggered by the base or primary game shown on display 1207, or by other game-independent events (for example, an RNG by the game processor 1301 or remote server independent of the base/primary game).

Figure 16:
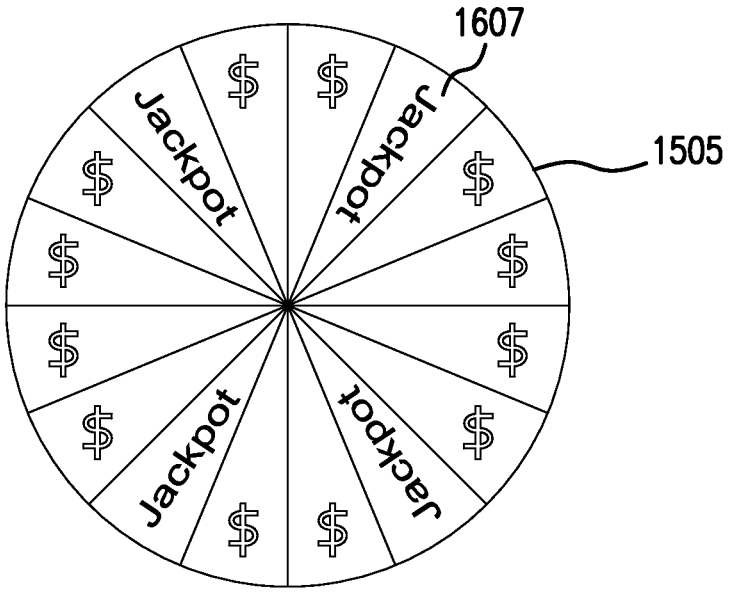
FIG. 16 is a representation of a second wheel graphic that may be produced on the display of the top box assembly in place of the wheel graphic shown in FIG. 15.
Figure 17:
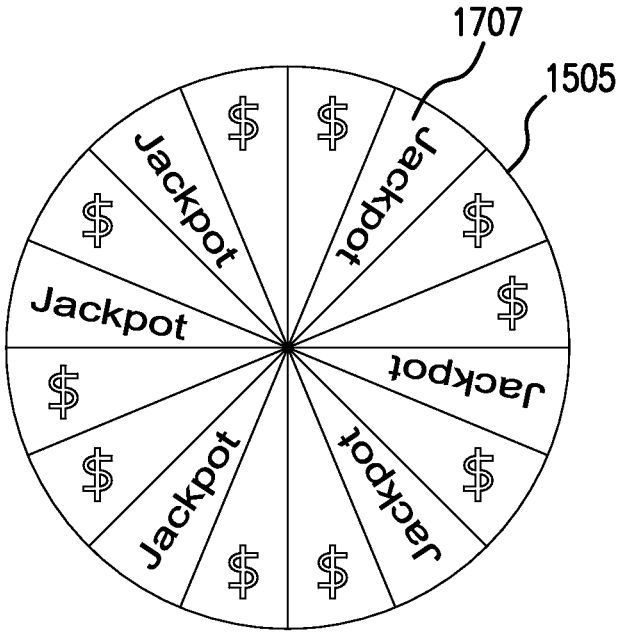
FIG. 17 is a representation of a third wheel graphic that may be produced on the display of the top box assembly in place of the wheel graphic shown in FIG. 15.

FIGS. 16 and 17 show variations on the wheel image which may be displayed in display area 1505 over the course of operation of top box 1500 shown in FIG. 15. For example, display area 1505 could be used to show a portion of a primary game, a secondary game, or a feature or bonus game in which multiple spins of a wheel are provided. In one spin, the wheel image could be implemented with segments 1607 including four separate jackpot wedges rather than the two shown in FIG. 15. In another spin of the wheel image, the image could be modified to show a total of six wheel wedges 1707 comprising jackpot wedges. On a given spin of the wheel, landing on any one of the "jackpot" wedges may pay a jackpot prize to the player, which may be a conventional prize according to a paytable or a progressive type prize.

Various wheel images may be programmed according to the invention. The number possible jackpot opportunities may be fixed depending upon the game with which the wheel image shown in area 1505 in FIG. 15 is associated. However, the programmability associated with the display device underlying area 1505 in FIG. 15 allows additional jackpot segments to be introduced onto the wheel depending upon the triggering event for the wheel game. For example, two jackpot segments may be programmed to display on the wheel display when a triggering event includes one special symbol appearing in the primary game, whereas four jackpot segments may be programmed to display when two special symbols appear in the primary game. Alternatively, the number of jackpot segments displayed may depend on the amount wagered. For example, six jackpot segments may be displayed when a player wagers a maximum bet including the wheel game feature (which may be an additional bet), whereas, two jackpot segments may be displayed when a player wagers a minimum threshold bet plus the wheel game feature. Similarly, the value of the additional segments may be increased based upon the amount wagered or the amount of special symbols appearing in the base game.

Figure 18:
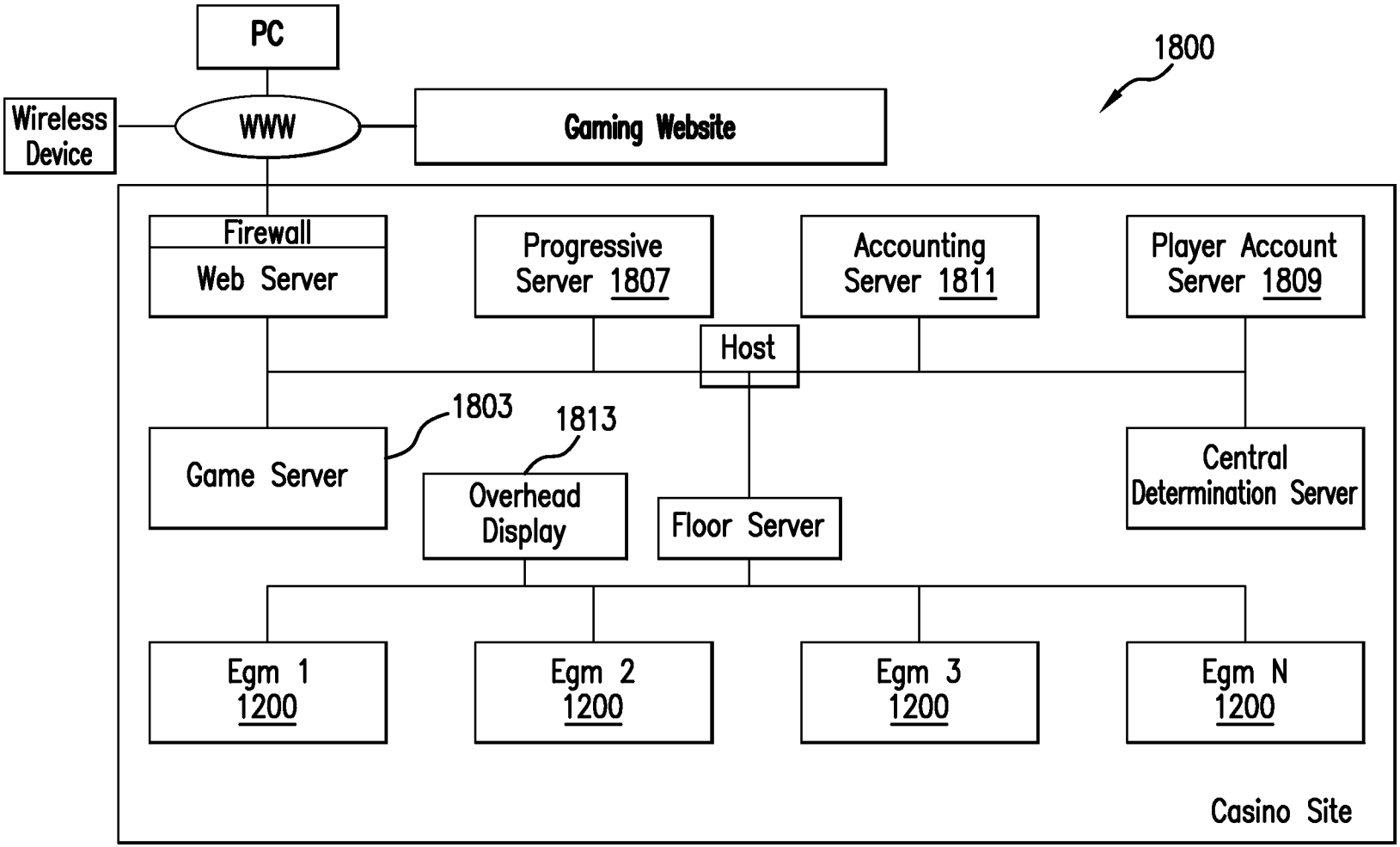
FIG. 18 illustrates a block diagram of an example gaming network in accordance with one or more embodiments.

FIG. 18 shows a block diagram of example networked gaming system 1800 associated with one or more gaming facilities. Networked gaming system 1800 includes one or more networked gaming machines 1200 having a top box (such as 1500 in FIG. 15) in accordance with one or more embodiments. With reference to FIG. 1800, while a few servers have been shown separately, they may be combined or split into additional servers having additional capabilities.

As shown, networked gaming machines 1200 (Egm 1-Egm N) and one or more overhead displays 1813 may be network connected and enable the content of one or more displays (such as primary display 1207 or display area 1505 or 1513) to be mirrored or replayed on an overhead display. For example, the primary display content may be stored by the display controller or game processor 1301 and transmitted through network controller 1307 (in FIG. 13) to the overhead display controller either substantially simultaneously or at a subsequent time according to either periodic programming executed by game processor 1301 or a triggering event, such as a jackpot or large win, at a respective gaming machine 1200. In the event that gaming machines 1200 have cameras installed, the respective players' video images may be displayed on overhead display 1813 along with the content of the player's display device 1207 or display areas 1505 or 1511 and any associated audio feed.

In one or more embodiments, game server 1803 may provide server-based games and/or game services to network connected gaming devices, such as gaming machines 1200 (which may be connected by network cable or wirelessly). Progressive server 1807 may accumulate progressive awards by receiving defined amounts (such as a percentage of the wagers from eligible gaming devices or by receiving funding from marketing or casino funds) and provide progressive awards to winning gaming devices upon a progressive event, such as a progressive jackpot game outcome or other triggering event such as a random or pseudo-random win determination at a networked gaming device or server (such as to provide a large potential award to players playing the community feature game). Accounting server 1811 may receive gaming data from each of the networked gaming devices, perform audit functions, and provide data for analysis programs, such as the IGT Mariposa™ program bundle.

Player account server 1809 may maintain player account records, and store persistent player data such as accumulated player points and/or player preference information. In one or more embodiments, when a player card is inserted in the card reader, an identification code may be read from the card and transmitted to player account server 1809. Player account server 1809 transmits player information through network controller 1307 (FIG. 13) to player interface 1305 for display on a player interface display. The player interface display may provide a personalized welcome to the player, the player's current player points, and any additional personalized data. If the player has not previously made a selection, then this information may or may not be displayed.

Figure 19:
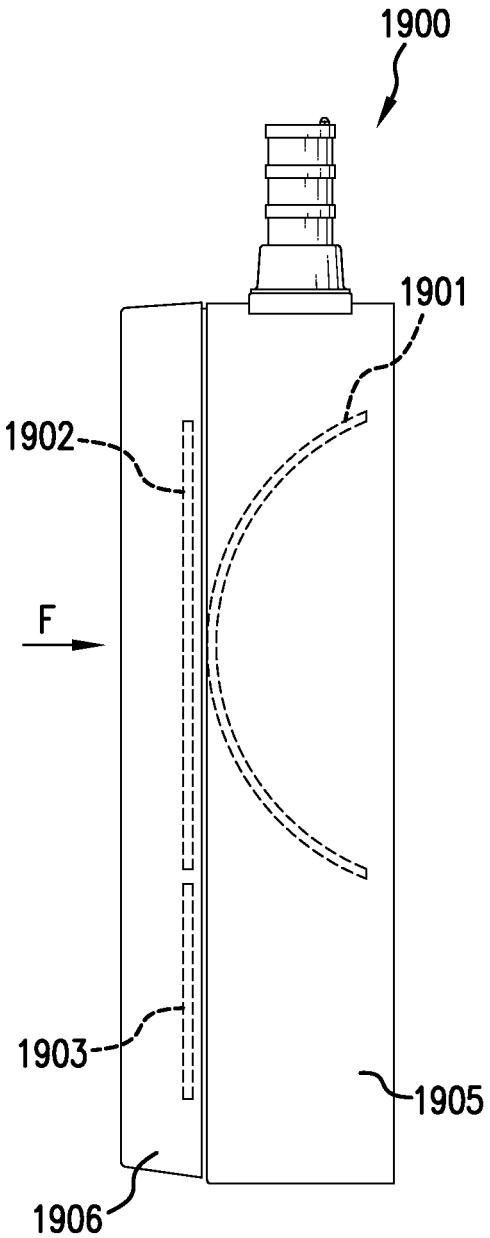
FIG. 19 is a somewhat diagrammatic side view of an alternate top box assembly having a convex curved display.

Numerous variations are possible on the top box structure (100 in FIG. 1 1500 in FIG. 15) described above. For example, display 201 (FIG. 2) may be any type of display such as a 3D display for example, rather than a 2D display. Any such display may have one or more touch sensitive areas for allowing player interaction. FIG. 19 shows a top box 1900 similar to that shown at 100 and 1500 above, but having a convex display 1901 used to provide at least part of the image in the display area corresponding to area 108 in FIG. 1 visible from the front of top box 1900 in direction F. Such a convex surface may be produced using a flexible organic light emitting diode (FOLED) display, or perhaps with other technology. The convex curvature of display 1900 may be in all directions around a center axis of the display (horizontal in the orientation of the figure). The convex display 1901 may be visible behind a light transmissive display device or translucent display device 1902. Alternatively, a clear panel may be placed over convex curved display 1901 in the position of device 1902. Either device 1902 or a clear panel may have touch sensitive areas for allowing player interaction with the top box. FIG. 19 shows a separate display device 1903 in position to provide graphics in an area of top box 1900 corresponding to area 112 in FIG. 1. The example shown in FIG. 19 assumes that display 1900 is positioned in the housing 1905 of top box 1900 (where housing 1905 corresponds to housing 101 in FIG. 1). However, in other implementations, convex display 1901 may be mounted on the door assembly 1906 (which corresponds to door assembly 102 in FIG. 1).

Figure 20:
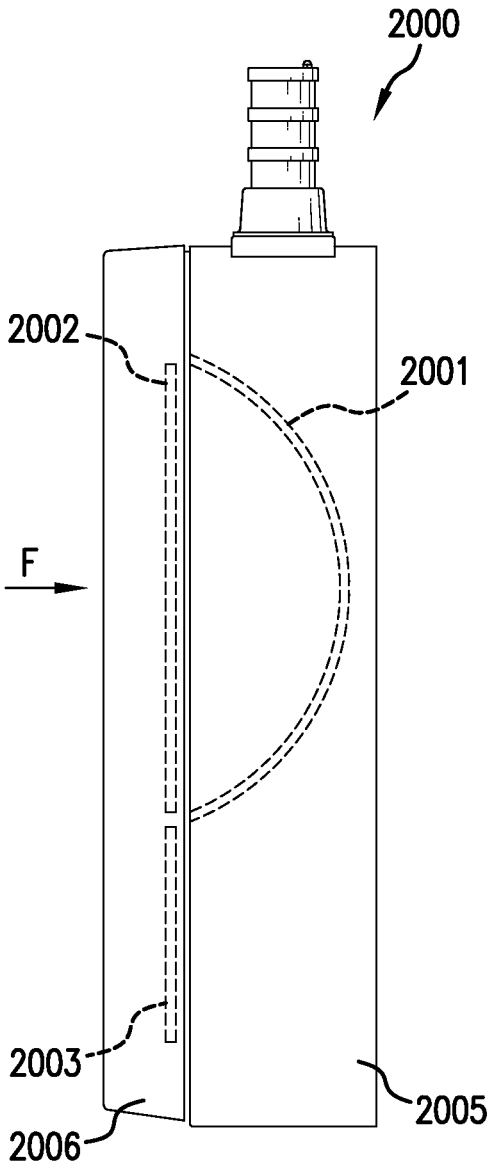
FIG. 20 is a somewhat diagrammatic side view of an alternate top box assembly having a concave curved display.

FIG. 20 shows another implementation of a top box 2000 corresponding to top box 100 shown in FIG. 1. This implementation includes a concave display 2001 to provide at least a portion of the image in the area corresponding to area 108 in FIG. 1. This area is viewable from the front of top box 2000 in the direction indicated by arrow F in FIG. 20. As with the embodiment in FIG. 19, a light transmissive display 2002 may be positioned over the display 2001, or a simple clear cover may be used. Either of these may have touch sensitive portions. The embodiment of FIG. 20 shows a separate lower display 2003 in the position of display area 112 shown in FIG. 1. This area too may be implemented as a touch sensitive screen as with the other embodiments described herein. Concave display may be mounted on housing 2005 (corresponding to housing 101 in FIG. 1) or on the door assembly 2006 (corresponding to door assembly 102 in FIG. 1).

It will be appreciated that a spatially shaped display used in a top box according to the invention need not have the same convex or concave curvature illustrated in the examples of FIGS. 19 and 20. Rather, the display may be conical or any other shape. For example, a conical or other display may show a roulette wheel. A transparent display over the conical display or other display (in the position of display 1902 in FIG. 19 for example) may be used to show a ball bouncing along roulette wheel. The overlaying display may be operated to display various effects as the ball bounces or after coming to a stop, for example, fireworks and the display of the player's award.

Referring generally to the forgoing description and the following claims, as used herein the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term). The term 'presentation' as used herein is meant to refer to the display of any image and/or video performance and/or the performance of one or more sound bites or audio tracks (such as digital or analog sound tracks or information stored on a memory device and processed by an audio controller to emit sound through a speaker) whether in an attract mode or as part of a game presentation or outcome.

The above described example embodiments are intended to illustrate the principles of the invention, but not to limit the scope of the invention. Various other embodiments and modifications to these preferred embodiments may be made by those skilled in the art without departing from the scope of the present invention. For example, although a single display 201 is shown as underlying both area 108 and 112 in the embodiment of FIGS. 1 and 2, two different display devices could be used. For another example, in one or more embodiments, the wheel display area may instead be shaped in a square or rectangular or other polygon shape with a correspondingly shaped bezel overlaying the underlying display. For instance, the display area may have the shape of a game board, such as Monopoly, whereon an element may jump (or appear to jump) from place to place along the perimeter until stopping at a location which may have an associated award, a free turn, or a multiplier (such as of a base game award). In other embodiments, the surface of the display area may appear to be a racetrack whereon one or more cars (or horses, dogs, etc.) may be shown to race and one or more of which may be associated with the player. I this case the associated player may receive an award based on the race outcome. During the game, recorded sound effects may be performed or played corresponding to the displayed events (e.g. engines being revved, cars crashing, dogs barking, hooves pounding the track, etc.), and celebratory A/V performances may be presented following the game.

It will be noted that the accent light/top box light arrangement shown in the present figures with the lighting arrangement in an annulus around the circular wheel-shaped display area allows for highly entertaining effects. In particular, the annular lighting arrangement has the effect of expanding the impact of wheel images provided on the circular display area (108 in FIG. 1) without having to provide a larger top box display. The annularly arranged lights (1102 in FIG. 11) may be operated to provide a motion effect corresponding to the motion of the spinning wheel (displayed in area 108 in FIG. 1) or counter to the motion of the spinning wheel. The annular peripheral lighting arrangement also allows an expansion of a tunnel effect provided on the display (in area 108 in FIG. 1).

The invention claimed is:

1. A top box wheel assembly including:

a video display mounted on a rectangular shaped top box housing in a front opening of the top box housing;

a bezel structure connected to the top box housing in an operating position so as to cover the front opening of the top box housing and the video display;

an inner frame included in the bezel structure, the inner frame defining an inner frame opening;

an outer frame included in the bezel structure; and a diffuser plate included in the bezel structure, the diffuser plate being formed from a planar sheet of material and including a wheel-shaped opening, the inner frame being mounted on the diffuser plate with the inner frame opening in registry with the wheel-shaped opening such that the inner frame defines an area through the bezel structure through which a wheel-shaped display area of the video display is visible, and the outer frame being mounted on the diffuser plate such that the outer frame defines a periphery of the bezel structure with an annular area defined between a portion of the circumference of the inner frame and a circular portion of the outer frame, the inner frame and the outer frame being mounted on the diffuser plate such that the diffuser plate maintains the position of the inner frame relative to the outer frame.

2. The top box wheel assembly of claim 1 wherein the bezel structure includes a rectangular cutout portion formed in the diffuser plate and positioned such that a rectangular-shaped display area of the video display is visible there through.

3. The top box wheel assembly of claim 1 wherein the bezel structure includes a pattern of accent lights located around at least a portion of the annular area between the inner frame and the outer frame, the accent lights being synchronously or quasi-synchronously operable with a rotating wheel displayed in the wheel-shaped display area.

4. The top box wheel assembly of claim 3 wherein the annular area has a width which is greater than a width of the rectangular-shaped top box housing.

5. The top box wheel assembly of claim 4 wherein the pattern of accent lights comprises a series of lines of lights, with each line of lights extending radially with respect to the wheel-shaped display area, and further including a plurality of accent light boards mounted on the diffuser plate, each accent light board including a plurality of the lines of lights.

6. The top box wheel assembly of claim 3 further including an accent light controller operable to control each of the accent lights, the accent light controller including a processing device which executes program code to produce control signals for the accent lights.

7. The top box wheel assembly of claim 6 wherein the accent light controller is operable to generate accent light state signals for a game processor, the accent light state signals each indicating a certain state of the accent lights.

8. The top box wheel assembly of claim 1 wherein the video display is mounted on the top box housing so that a front surface of the video display protrudes out of the front opening of the top box housing.

9. A gaming system including:

two or more gaming machines, each gaming machine including:

a player interface operative to receive a player input; and a display device operative to display a wagering game result at the gaming machine responsive to the first player input, the display of the wagering game result indicating an award if the wagering game result is a winning result; and at least one of the gaming machines including a top box wheel assembly including:

a video display mounted on a rectangular shaped top box housing in a front opening of the top box housing;

a bezel structure connected to the top box housing in an operating position so as to cover the front opening of the top box housing and the video display;

an inner frame included in the bezel structure, the inner frame defining an inner frame opening;

an outer frame included in the bezel structure; and a diffuser plate included in the bezel structure, the diffuser plate being formed from a planar sheet of material and including a wheel-shaped opening, the inner frame being mounted on the diffuser plate with the inner frame opening in registry with the wheel-shaped opening such that the inner frame defines an area through the bezel structure through which a wheel-shaped display area of the video display is visible, and the outer frame being mounted on the diffuser plate such that the outer frame defines a periphery of the bezel structure with an annular area defined between a portion of the circumference of the inner frame and a circular portion of the outer frame, the inner frame and the outer frame being mounted on the diffuser plate such that the diffuser plate maintains the position of the inner frame relative to the outer frame.

10. The gaming system of claim 9 wherein the bezel structure includes a rectangular cutout portion formed in the diffuser plate and positioned such that a rectangular-shaped display area of the video display is visible there through.

11. The gaming system of claim 9 wherein:

the bezel structure includes a pattern of accent lights located around at least a portion of the annular area between the inner frame and the outer frame, the accent lights being synchronously or quasi-synchronously operable with a rotating wheel displayed in the wheel-shaped display area;

the annular lighting area has a width which is greater than a width of the rectangular-shaped cabinet top box housing; and the pattern of accent lights comprises a series of lines of lights, with each line of lights extending radially with respect to the wheel-shaped display area and being mounted on one of a plurality of accent light boards secured within the bezel structure.

12. The gaming system of claim 11 further including an accent light controller operable to control each of the accent lights, the accent light controller including a processing device which executes program code to produce control signals for the accent lights, and wherein the accent light controller is operable to generate accent light state signals for a game processor, the accent light state signals each indicating a certain state of the accent lights.

13. The top box wheel assembly of claim 9 wherein the video display is mounted on the top box housing so that a front surface of the video display protrudes out of the front opening of the top box housing.

* * * * *